United States Patent [19]

Drabkin

[11] Patent Number: 5,039,976

[45] Date of Patent: Aug. 13, 1991

[54] HIGH-PRECISION, HIGH-STABILITY RESISTOR ELEMENTS

[76] Inventor: Alexander Drabkin, 30 Eilat Street, Holon, Israel

[21] Appl. No.: 482,584

[22] Filed: Feb. 21, 1990

[30] Foreign Application Priority Data

Feb. 22, 1989 [IL] Israel ..... 89384

[51] Int. Cl.[5] ..... H01C 1/012

[52] U.S. Cl. ..... 338/314; 338/7; 338/195; 338/254; 338/309; 338/333

[58] Field of Search ..... 338/314, 7–10, 338/195, 254, 255, 308, 309, 333; 29/610.1

[56] References Cited

U.S. PATENT DOCUMENTS 4,172,249 10/1979 Szwarc ..... 338/195
4,286,249 8/1981 Lewis et al. ..... 338/275
4,318,072 3/1982 Zandman ..... 338/7
4,378,549 3/1983 Szwarc ..... 338/195
4,570,150 2/1986 Zandman et al. ..... 338/329
4,677,413 6/1987 Zandman et al. ..... 338/7

*Primary Examiner*—Marvin M. Lateef
*Attorney, Agent, or Firm*—Benjamin J. Barish

[57] ABSTRACT

A high-precision and high-stability resistor element, which exhibits zero, or close to zero, resistance deviation during time and in given temperature and power ranges, includes a bonded sandwich of several substrates of inorganic insulating material having a substantially zero coefficient of thermal expansion with one or more R (Resistance) and TCR (Temperature Coefficient of Resistance) trimmed resistive metal foil patterns which can be retrimmed in two directions during periodic verifications.

25 Claims, 5 Drawing Sheets

FIG. 8
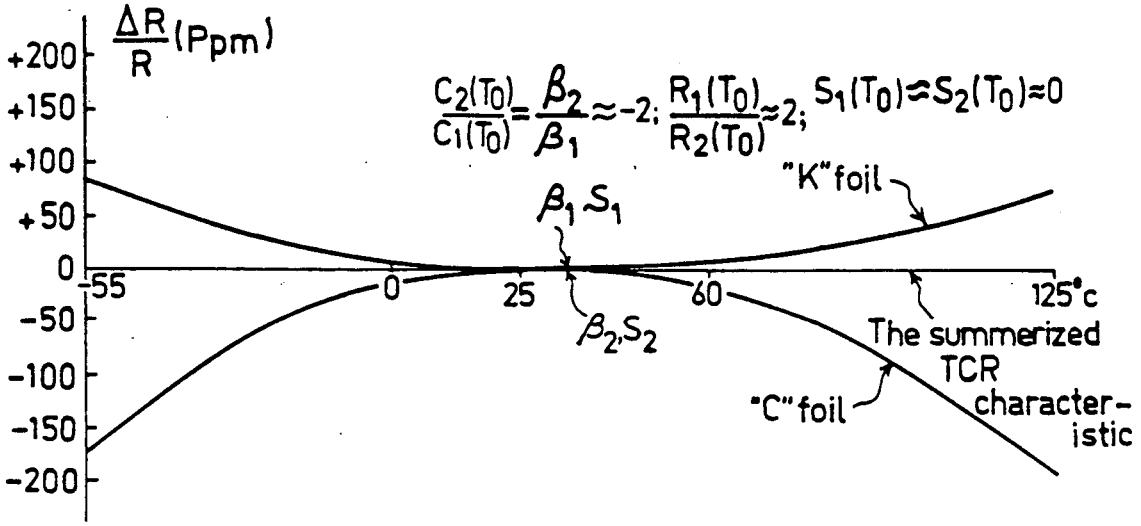
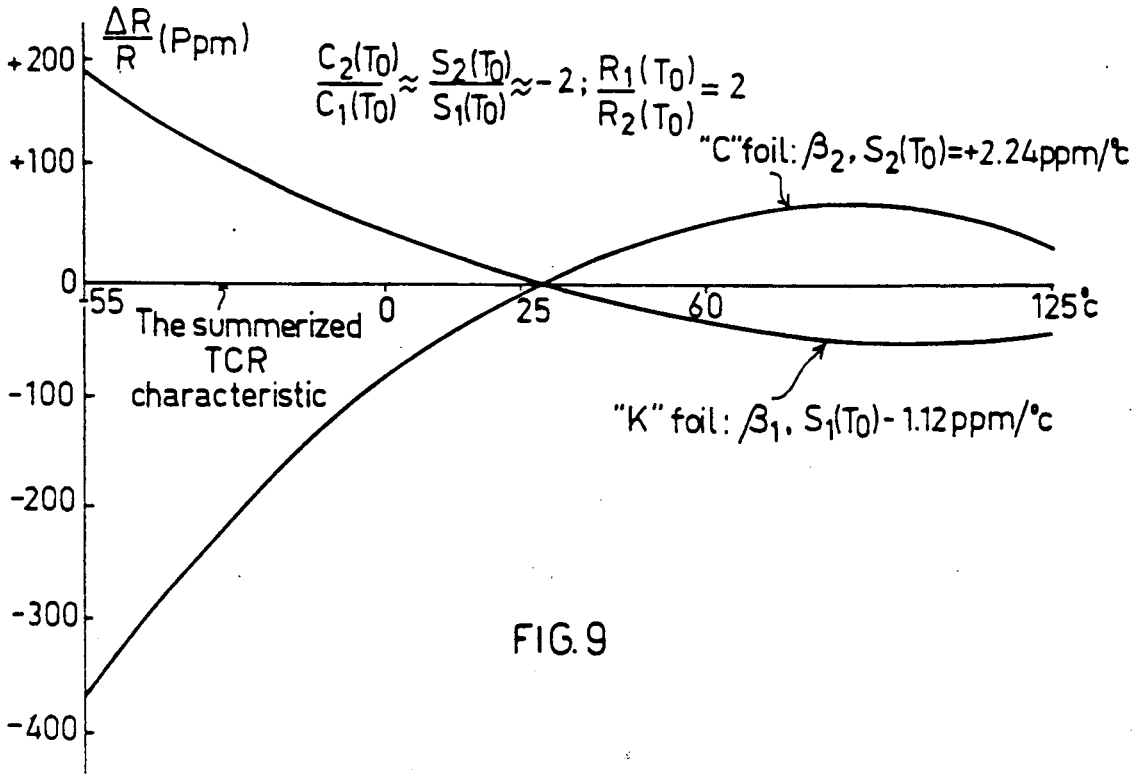
FIG. 9

HIGH-PRECISION, HIGH-STABILITY RESISTOR ELEMENTS

BACKGROUND OF THE INVENTION

The present invention relates to very precise and stable metal foil resistor elements intended for R-standards, and also to high precision devices, such as multimeters, R-bridges, R-decade boxes, R-potentiometers and other resistor networks, which may use such resistor elements and which thereby would obviate the need for frequent control tests and retrimming by using supplemental R-standard resistors.

A wide variety of applications could advantageously use such precise and stable resistor elements. The existing resistors, having precise and low temperature coefficients of resistance (TCR), are very small and are therefore easily incorporated into electronic instruments; however, they cannot be used as R-standards, e.g., as SR104 of ESI R-standard, because of their insufficient accuracy and stability (shelf life, power and thermal shocks), and because of their low rated power dissipation. On the other hand, the known R-standard resistors having high precision, high stability and high power dissipation, are very expensive, are of large size, are time consuming for steady state conditions, and generally are intended only for checking and measuring electrical circuits under laboratory conditions.

The absence of such resistor elements of high precision, high stability, relatively high power dissipation, and low cost impedes the development and design of many instruments, which in turn impedes the development of measuring techniques.

The majority of the shortcomings in the existing photo-etched metal foil resistors are caused by the following:

a. the small size of the chips, and accordingly the small width of the lines and spaces of the resistive patterns path: thus, the deleterious effects induced by the "notches", "holes" and "bridges" upon R-stability, resulting from the exiting metal-foil and photo-etching technology, are increased when decreasing the width of the lines and the spaces, depending on the thickness and the quality of the foil and the standard of photo-etching procedure; also, the small surface of the chip does not allow to dissipate high power;

b. the influences of the surrounding environment: for example, oil absorbed at elevated temperatures by cement layers, and their shrinkage and "creep" occurring at high shear stresses, cause substrate and metal foil pattern deformations and resistance deviation.

An object of the present invention is to provide a resistor element having important advantages in the above respects.

DEFINITION OF TERMS AND BASIC FORMULA

Below are defined a number of terms generally accepted in the production of metal foil resistors and used in the description below of the present invention. Also discussed below are results of general analysis of temperature dependence of metal foil resistors as utilised in this invention. It can be approximated for this analysis that materials of metal foils and substrates are isotropic.

a. Pattern—a metal foil resistive element, photo-etched or etched in an other way, bonded to an insulating substrate and comprising series connected non-trimming (i.e., nonadjustable resistive part, trimming steps or fired and termination pads (e.g., conductive platings) for external connections.

b. TCR-characteristic—the temperature dependence of relative resistance change of the bonded metal foil pattern(s) of resistance R, i.e.

$$\frac{\Delta R}{R(T_o)} = \frac{R(T_o, \Delta T_f, \Delta T_s) - R(T_o)}{R(T_o)}, \text{ where:}$$

$T_o$—is the middle of the given temperature range of resistor elements; $\Delta T_f$, $\Delta T_s$—are the temperature deviations of the pattern foil and substrate from the middle temperature $T_o$; and $R = R(T_o, \Delta T_f, \Delta T_s) - R(T_o)$ —are the resistance changes due to temperature changes $\Delta T_f$ and $\Delta T_s$ of the pattern foil and substrate, to which it is bonded.

c. Slope $S(T_o)$—is the slope of the TCR-characteristic at the middle temperature $T_o$:

$$S(T_o) = \left.\frac{d\left(\frac{\Delta R}{R(T_o)}\right)}{d(\Delta T_f)}\right|_{\substack{\Delta T_s=0\\ \Delta T_f=0}} \tag{1}$$

d. Curvature $C(T_o)$ is the curvature or nonlinearity of the TCR-characteristic at the middle temperature $T_o$:

$$C(T_o) = \tag{2}$$

$$\frac{d^2\left(\frac{\Delta R}{R(T_o)}\right)}{d(\Delta T_f)^2} \Big/ \left[\sqrt{1 + \left[\frac{d(\Delta R/R(T_o))}{d(\Delta T_f)}\right]^2}\right]^3_{\substack{\Delta T_s=0\\ \Delta T_f=0}} \approx$$

$$\left.\frac{d^2\left(\frac{\Delta R}{R(T_o)}\right)}{d(\Delta T_f)^2}\right|_{\substack{\Delta T_s=0 \text{ as}\\ \Delta T_f=0}}$$

$$\left|\left.\frac{d\left(\frac{\Delta R}{R(T_o)}\right)}{d(\Delta T_f)}\right|_{\substack{\Delta T_s=0=\\ \Delta T_f=0}}\right| \left.S(T_o)\right|_{\substack{\Delta T_s=0<<1\\ \Delta T_f=0}}$$

for precision resistors.

e. $R(T_o) = \rho(T_o) \times l_o$ is the Ohm's law for a bonded to insulating substrate unstrained metal foil strip (pattern) at initial temperature To, where $\rho(T_o)$—is the resistivity of the metal foil material at initial temperature $T_o$ equals the resistance per one foil's square, ohms/square; $l(T_o)$ —is the initial length of a strip (path of pattern) in units of squares.

The relative resistance change of the bonded metal foil $\Delta R/R(T_o)$ due to temperature changes $\Delta T_f$ and $\Delta T_s$:

$$\frac{\Delta R}{R(T_o)} = \Delta\rho/\rho(T_o) - K(\alpha_f \Delta T_f - \alpha_s \Delta T_s), \text{ where} \tag{3}$$

$\Delta\rho/\rho TO_o)$—is the relative change of resistivity due to temperature change, $\Delta T_f$, of the unstressed foil, equal to relative resistance change of the unstressed foil;

$-K(\alpha_f \Delta T_f - \alpha_s \Delta T_s)$—is the relative resistance change of the thermostressed bonded metal foil due to its strain- effect, $\alpha_f$, $\alpha_s$—are coefficients of thermal expansion of materials of metal foil and substrate; and K - is the strain gauge factor of the foil for uniform temperature deformation, dependent upon the foil material and is usually close to 2.

The nonlineary term $\rho/\rho$ $(T_o)$ can be represented by Taylor's power series of $\Delta T_f$:

$$\Delta\rho/\rho(T_o) = \alpha\Delta T_f + \beta\Delta T_f^2 + \gamma\Delta T_f^3 + \ldots \quad (4)$$

Substituting $\Delta\rho/\rho(T_o)$ in equation (3) by its expression (4), results in:

$$\frac{\Delta R}{R(T_o)} = S(T_o)(\Delta T_f^e + \Delta T_f^p) + \frac{C(T_o)}{2}(\Delta T_f^e + \Delta T_f^p)^2 + \gamma(\Delta T_f^e + \Delta T_f^p)^3 + \ldots + P_c(\Delta T_f^p - \Delta T_s^p), \quad (5)$$

where:

$S(T_o)=\alpha - K(\alpha_f - \alpha_s)$; $C(T_o)=2\rho$; $P_C=-K\alpha_s$;

$$\Delta T_f=\Delta T_f^e;\ \Delta T_s=\Delta T_s^e+\Delta T_s^p; \quad (6)$$

and $\Delta T_f^e$, $\Delta T_s^e$, $\Delta T_f^p$, $\Delta T_s^p$ - are temperature changes of external surroundings ($\Delta T_f^e=\Delta T_s^e$), and in the bonded metal foil and substrate due to the heat dissipation throughout the foil and the insulating substrates, i.e. due to the selfheating effect.

The last term of Equation (5) is directly proportional to $\alpha_s$ and to $(\Delta T_f^p - \Delta T_s^p)$ and refers to the heat stream dissipated per unit of metal foil pattern area. Therefore the coefficient $P_c$ of this term can be related to the power coefficient of resistance of a metal foil pattern and its value is always negative because it is caused by additional compression and the strain-effect of the pattern due to the lag of the substrate heating with respect to the metal foil pattern. From the other side, the selfheating of a sandwiched pattern, which has an effect somewhat similar to increasing external temperature, is directly proportional to resistance per unit of pattern area or to its equivalent number of series connected foil square for a given resistivity of the metal foil.

f. Two sandwiched patterns of the same selfheating.

If two series connected sandwiched patterns are made from metal foils of the same resistivity, then it is enough for their nearly equal selfheatings to use the same basic pitch and squares/pitch for the pattern paths.

(7) Basic pitch: p=l+s, and squares/pitch=p/(p-s), where l and s are the widths of the line and space of the path, and determine the overwhelming component of pattern resistance for the given resistivity of film and pattern surface. In this and in other cases of the same selfheatings, the following correlations can be written:

$$R_1 = R_1(T_o)\left[1 + S_1(T_o)(\Delta T_f^e + \Delta T_f^p) + \frac{C_1(T_o)}{2}(\Delta T_f^e + \Delta T_f^p)^2 + \gamma_1(\Delta T_f^e + \Delta T_f^p)^3 + \ldots + P_{c1}(\Delta T_f^p - \Delta T_s^e)\right]; \quad (8)$$

$$R_2 = R_2(T_o)\left[1 + S_2(T_o)(\Delta T_f^e + \Delta T_f^p) + \frac{C_2(T_o)}{2}(\Delta T_f^e + \Delta T_f^p)^2 + \gamma_2(\Delta T_f^e + \Delta T_f^p)^3 + \ldots + P_{c2}(\Delta T_f^p - \Delta T_f^p)\right]; \quad (9)$$

-continued $$R = R_1 + R_2 = R(T_o)\left[1 + S(T_o)(\Delta T_f^e + \Delta T_f^p) + \frac{C(T_o)}{2}(\Delta T_f^e + \Delta T_f^p)^2 + \gamma(\Delta T_f^e + \Delta T_f^p)^3 + \ldots + P_c(\Delta T_f^p - \Delta T_s^p)\right], \quad (10)$$

where:

lower indexes 1 and 2 concern the first and the second patterns;

(11) $R(T_o)=R_1(T_o)+R_2(T_o)$ - sum of the resistance of two patterns at temperature $T_o$;

$$S(T_o) = \frac{S_1(T_o)R_1(T_o) + S_2(T_o)R_2(T_o)}{R(T_o)}; \quad (12)$$

$$C(T_o) = \frac{C_1(T_o)R_1(T_o) + C_2(T_o)R_2(T_o)}{R(T_o)};$$

$$P_c = \frac{P_{c1}R_1(T_o) + P_{c2}R_2(T_o)}{R(T_o)}.$$

g. R-trimming step—a discrete part of the R-trimming section of a metal foil resistive pattern which is series connected to its non-trimming parts. It includes a resistive pattern of the step, and its shunt that can be cut and recovered (by soldering or welding), if the shunt is copper-nickel-gold plated and has sufficient size; in these ways, the pattern's resistance R is increased or decreased by the given step value.

h. TCR-trimming step—a part of a copper-nickel-gold plated TCR trimming section of the metal foil resistive pattern is series connected to its non-trimming parts, and includes a temperature sensitive step pattern of relative low resistance, and a shunt that can be cut and recovered (by soldering or welding, if it has sufficient size); in these ways the slope S of the pattern's TCR-characteristic is increased or decreased by given step value.

i. Copper-nickel-gold plating—the plating of the given region, and formed of a material selected from the group consisting of copper, nickel and gold.

j. Foil batches—metal foils produced from the same alloy batch but subjected to different thermal treatments in order to obtain different slopes of TCR-characteristics by keeping the curvature and resistivity substantially constant.

k. Foils modification—foils produced from the same basic alloy but with special alloying element(s) in order to change the sign and curvature value of the basic TCR-characteristic.

SUMMARY OF THE INVENTION

According to the present invention, therefore, there is provided a high-precision, highstability resistor element comprising a first substrate of insulating; a resistive metal foil pattern with low absolute values of its TCR-characteristic carried and bonded on one face of the substrate; and a second substrate of insulating bonded to the pattern so as to sandwich the resistive pattern between the two substrates.

In the preferred embodiments of the invention described detail below, the resistive pattern includes.

According to a further feature in the described preferred embodiments, the final R-trimming steps include copper-nickel-gold plated shunts which have sufficient sizes to permit both increasing the resistance by cutting out step shunts, and also decreasing the resistance by adding in-shunt steps, e.g., by soldering or welding.

According to another feature in the described preferred embodiments, the final trimming section further includes TCR-trimming steps formed similar to R-trimming steps but using appropriate copper-nickel-gold plating and have such sizes of cut and uncut shunts that permit carrying out TCR-trimmings in two directions, namely, by shunt soldering (welding) the cut shunts for TCR decreasing, and by cutting uncut shunts for TCR increasing.

According to a still further feature, the resistor element includes a second metal foil pattern, having the same order of magnitude of TCR-characteristic but of smaller size than the first-mentioned pattern, carried and bonded on the opposite face of said second substrate and series connected to the first-mentioned pattern; and a third substrate made of the same insulating material as the other two substrates and bonded to said second pattern so as to sandwich it between the second and third substrates.

Similar to the above, other embodiments of the invention may include two substrates with metal foil series connected patterns bonded to them but placed in one plane in side-by-side relation so as to form a rectangle. A common third substrate, smaller than the above rectangular one, is bonded to it and sandwiches the two patterns so that on the exposed side margins of the patterns ar located only pad terminations with connecting leads and paths of cut and uncut shunts of the final steps.

The invention thus provides a high-precision and high-stability resistor element which exhibits virtually zero or close to zero resistance deviation during time and in given temperature and power ranges. The resistor element comprises a bonding together, in the form of a sandwich, of several insulating substrates with series connected resistive metal foil patterns located and bonded from both sides by a cement between adjacent substrates. Each of these patterns is made from resistive metal foil with low absolute values of slope and curvature of its TCR-characteristics, and includes series connected non-trimming parts, coarse R-trimming steps, final trimming steps and copper-nickel-gold plated termination pads for external and inner series connections of the patterns. Each pattern also includes side margins carrying pad terminations having external and internal connecting leads, and also paths of cut and and uncut shunts of final trimming steps as the remaining resistive parts of the pattern (including coarse R-trimming steps), stability of which is the main object of the invention, is bonded adjacent to its smaller substrate so that final trimming of each pattern and the whole element is carried out on the above margins while the sandwich is assembled. After final trimmings, these margins and all external junctions are protected by appropriate hermetic materials that may be chosen to be removable from the regions of shunts to permit retrimmings of the resistor element during its periodical verification or recalibration.

As will be described more particularly below, the invention may be embodied in a resistor element having a single resistive pattern sandwiched between two insulating substrates, the trimming marginal step shunts of the resistive pattern permitting not only initial trimming of the resistive element, but also R-and TCR-retrimming whenever necessary or desired in order to provide compensation of R- and slope S-deviations exhibited by the TCR-characteristic of the resistive pattern. Preferably, however, the resistor element includes two resistive patterns sandwiched between three insulating substrates, because in this case it is possible to select foil modifications, foils batches, and resistance values of the resistive patterns so that the curvature and slope of the combined TCR-characteristic are virtually zero or close to zero at the middle of a given temperature range.

In all the described embodiments, each of the substrates is preferably made of insulating inorganic material having a substantially zero coefficient of thermal expansion or as close to zero as possible. Thus, each substrate is preferably made of a ceramic material having a thickness of 0.51–2.54 mm (20–100 mils), and a thermal expansion of less than $6.3\times10^{-6}/^{o}C$ ($3.5\times10^{=6}/^{o}F$). The substrates are bonded together by an adhesive having no volatile components, high adhesion, high shear stress, high thermal stability, and no appreciable creep.

The resistor element may further include side plates covering and bonding the sides where there are margins with paths of cut and uncut shunts of the final R- and TCR-trimming steps and termination pads with connecting leads.

Although the size of the basic pattern (having the most surface) is not limited, it is preferably not less than 5 times the size of a standard pattern for the sake of R-standards of high accuracy, and is intended not only for increasing the R-stability and power dissipation of the resistor element, but also, together with the copper-nickel-gold plating of the final step shunts, for lengthening the shunts to facilitate recovering the cut shunts (by soldering or welding) and hence, to carry out the R- and TCR-trimmings of the resistor element in two directions during its production or verification.

R-trimming of resistor elements can be carried out with an accuracy up to 0.2–0.5 ppm, and TCR-trimming with an accuracy of up to 0.01–0.02 ppm/$^{o}$C. In the case of one pattern resistor element (see FIGS. 1 and 2), the metal foil modification and batch are chosen with minimum $C(T_o)$ (nonlinearity) and with negative slope $S(T_o)$, in the given limits, of its own (without TCR steps) TCR-characteristic so that it will be possible to increase it up to zero. During periodic verification testing of the resistor elements, it is possible to carry out R and TCR retrimmings in two directions, that is both positive and negative. The influence of power dissipation upon resistance deviation is eliminated by selecting a substrate material having a coefficient of thermal expansion close to zero, as in this case the pattern power coefficient $P_c=-K\alpha_s$ (see 6), as well as the resistance deviation after power application, is close to zero.

Resistor element of two patterns assembled with three insulating substrates is the most preferable with respect to the least temperature resistance deviation in the given temperature range (FIGS. 8 and 9). In this case, as it follows from Equations (10) and (12) above, the conditions exist to achieve simultaneously zero slope $S(T_o)$ as well as zero curvature $C(T_o)$ (nonlinearity) of TCR-characteristic of the resistor element. Namely:

$$C = 0 \text{ when } \frac{C_2(T_o)}{C_1(T_o)} = -\frac{R_1(T_o)}{R_2(T_o)} \quad (13)$$

and $$S = 0 \text{ when } \frac{S_2(T_o)}{S_1(T_o)} = -\frac{R_1(T_o)}{R_2(T_o)} \quad (14)$$

or $$S = 0 \text{ when } S_1(T_o) \approx 0 \text{ and } S_2(T_o) \approx 0 \quad (15)$$

From Equations (13), (14) and (15), it follows that for linearization and zero slope of the combined TCR-characteristic, it is necessary to provide metal foils with opposite curvatures and slopes and with equal ratios; also, the resistance ratio of the patterns should be equal to the inverse ratio of the absolute values of their curvatures or slopes.

Nickel-chromium alloys, like Evanom, and modifications made by Wilbur B. Driver and other companies, are widely used for metal foil resistor and strain gauge production. Well known are two modifications of these alloys with opposite curvatures: "C" foil and "K" foil (see FIGS. 7 and 8) having ratio:

$$\frac{C_o}{C_x} \approx -2$$

and different slopes. As it is known to those skilled in this art, each resistive alloy modification used for metal foil resistors and strain gauges including nickel-chrome alloys is characterized by more or less steady curvature; and many foil batches are formed with different slopes depending upon the thermal treatment that the foil was subjected. This allows one to choose the thermal treatment of the foils with a given C ratio (13) appropriate for the necessary ratio (14) or correlation (15).

The construction of two series-connected patterns of resistor elements with three substrates is similar to the construction of one pattern resistor element. The first basic pattern is constructed with a lower absolute value of curvature $C_1(T_o)$, and therefore with a higher resistance $R_1(T_o)$, and of the largest substrates size, and then to the basic pattern is bonded or joined the next substrate with a pattern of greater absolute value and opposite sign of curvature $C_2(T_o)$ and lower resistance $R_2(T_o)$, and finally bonding the third substrate to the second pattern or to both patterns.

Resistor elements constructed in accordance with the foregoing features exhibit very high-precision and high-stability over a significant temperature range, and also permit convenient recalibration whenever necessary to maintain the precision. Such resistor elements may be constructed as relatively small and compact units making them suitable not only for incorporation into electrical instruments requiring resistors of high precision and of high stability, but also as individual resistor units usable as reference resistors for calibration of other resistor circuits. Also, the simplest versions of the proposed resistor elements can be used as more stable and accurate alternatives to the existing metal foil resistors of low sizes due primarily to sandwiching of their patterns.

Further features and advantages of the invention will be apparent from the description below.

BRIEF DESCRIPTION OF THE DRAWINGS

The invention is herein described, by way of example only, with reference to the accompanying drawings, wherein:

FIGS. 8 and 9 illustrate separate TCR-characteristics of the thermal-compensated double-pattern resistor element when the combined TCR-characteristic has $C(T_o)=0$ and $S(T_o)=0$; FIG. 8 illustrating the case of $C_1(T_o)/C_1(T_o)=-2$, $R_1(T_o)/R_2(T_o) \approx 2$, $S_1(T_o)\approx 2$, $S_1(T_o)\approx D$, $S(T_o)\approx O$ and FIG. 9 illustrating the case of $C_2(T_o)/C_1(T_o)\approx -2$, $R_1(T_o)/R_1(T_o)\approx 2$, but $S_1(T_o)=-1.24$ ppm/°C, $S_2(T_o)=2.48$ ppm/°C and $S_2(T_o)/S_1(T_o)=-2$.

The numerical signs, which are identical for all drawings, identifying the following elements:

1—resistor element.

$2_1$—the basic metal foil pattern of the single and the double-pattern resistor elements.

$2_2$—the second metal foil pattern of the doublepattern resistor element.

$3_1$—the insulating substrate for the basic metal foil pattern.

$3_2$—the second insulating substrate closing one pattern resistor element or intended for the second metal foil pattern of the double-pattern resistor element.

$3_3$—the third insulating substrate closing the double-pattern resistor element.

$4_1$, $4_2$—the cement layers bonding the basic and the second patterns to the first and the second insulating substrates.

$5_1$—$5_1$, $5_2$—$5_2$—the copper-nickel-gold plated termination pads of the basic and the second patterns.

Figure 5:
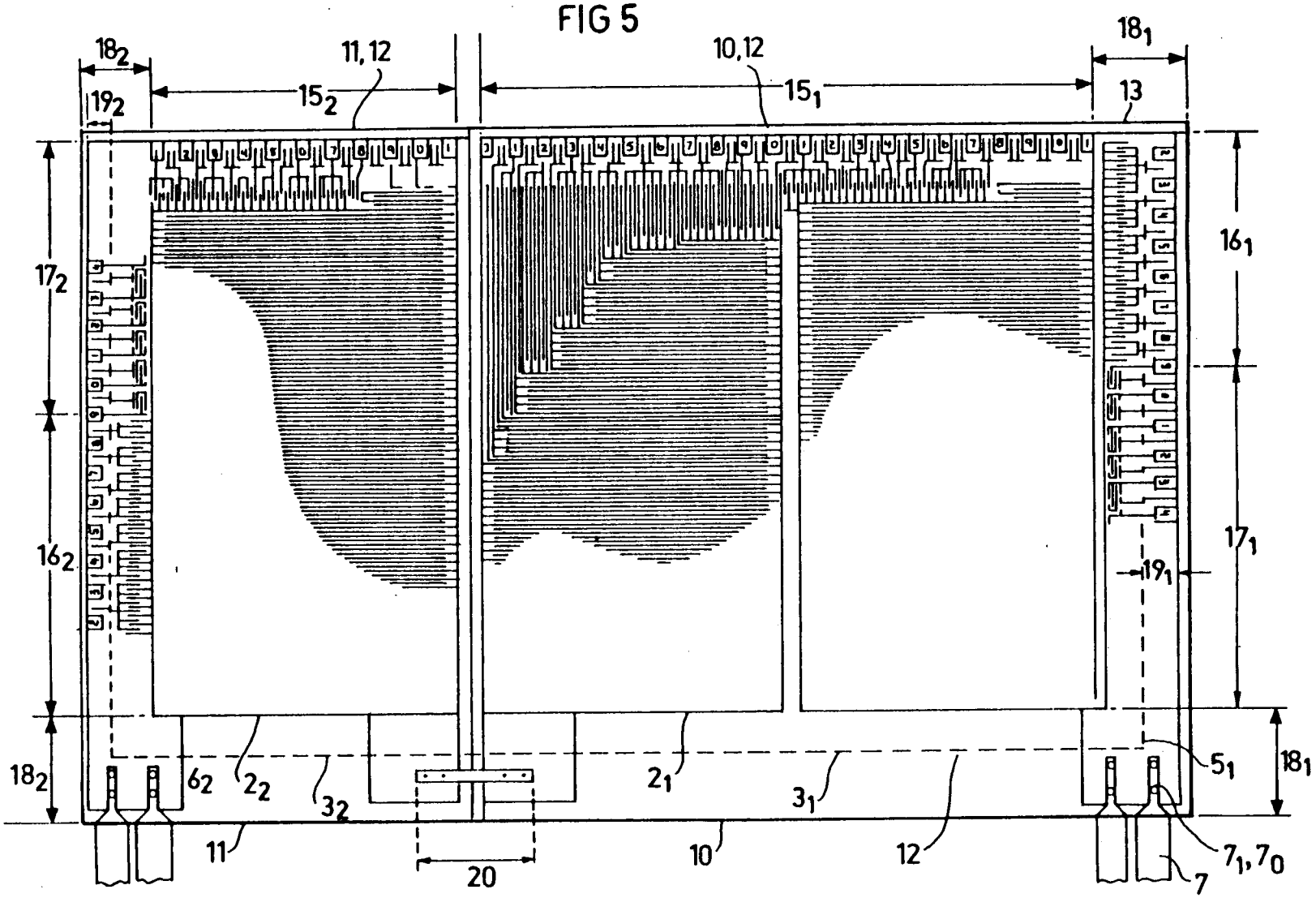
FIG. 5 is a plan view illustrating two patterns in the double-pattern resistor element of a second version.

$6_1$—$6_2$—the cement layers bonding accordingly, the substrates $3_1$—$3_2$ and $3_2$—$3_3$ (FIGS. 1, 3) or $3_1$—$3_3$ and $3_2$—$3_3$ (FIG. 5).

$6_3$, $6_4$—the sealing materials: irremovable ($6_3$) and removable ($6_4$).

7, $7_0$, $7_1$, $7_2$—the monolithic connecting leads including: the most flexible flattened part ($7_1$) intended for connections from the pad to the external lead, the flattened part of less flexibility ($7_2$) being bonded to the external side of the substrate, and the final cylindrical part of conventional leads (7) being for external connections.

8—drops of cement for anchoring the final part (7) of the connecting leads.

9—the four-terminal leads for external connections.

10, 11, 12—the borders of substrates $3_1$, $3_2$, $3_3$.

13, 14—the borders of patterns $2_1$ and $2_2$.

$15_1$, $15_2$—the coarse R-trimming steps of the basic and the second patterns.

$16_1$ and $17_1$, $16_2$ and $17_2$—the final TCR- & R-trimming steps of the basic and the second patterns.

$18_1$, $18_2$—the margins of the basic and the second patterns.

$19_1$, $19_2$—the paths of copper-nickel-gold plated shunts of the final trimming steps of the basic and the second patterns.

20—the intermediate, series connections of the patterns.

DETAILED DESCRIPTION OF PREFERRED EMBODIMENTS

Although special forms of the invention have been selected for illustration in the drawings and in the examples, and the description is drawn in specific terms for purpose of describing these forms of the invention, it will be appreciated the above are not intended to limit the scope of the invention which is defined in the appended claims.

Figure 1:
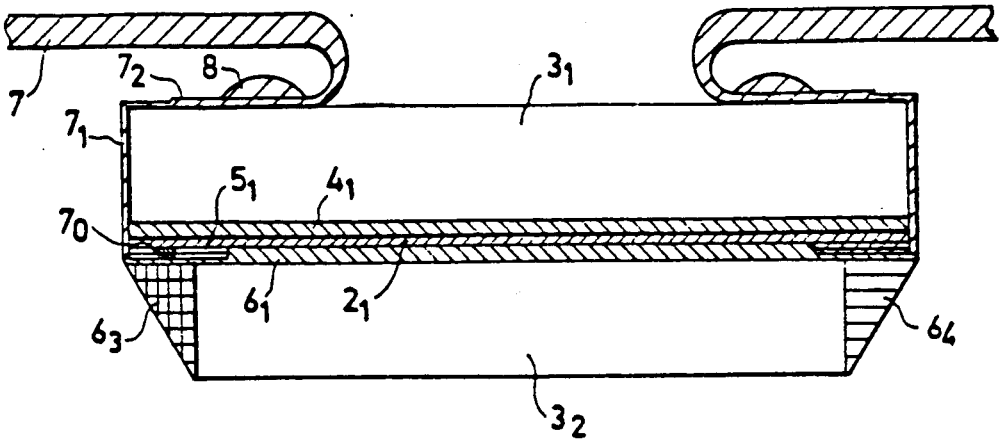
FIG. 1 is a transverse sectional view illustrating one form of single-pattern resistor element constructed in accordance with the present invention.

FIGS. 1–7 illustrate four embodiments of sealed resistor elements constructed in accordance with the present invention. FIG. 1, 3, 7 are transverse sectional views of three embodiments with a single (FIG. 1) and two (FIGS. 3, 7) patterns (the first version). A transverse sectional view of the fourth embodiment (two-pattern resistor element of second version) is not presented as it is similar, to some extent, to the view of FIG. 1.

Figure 3:
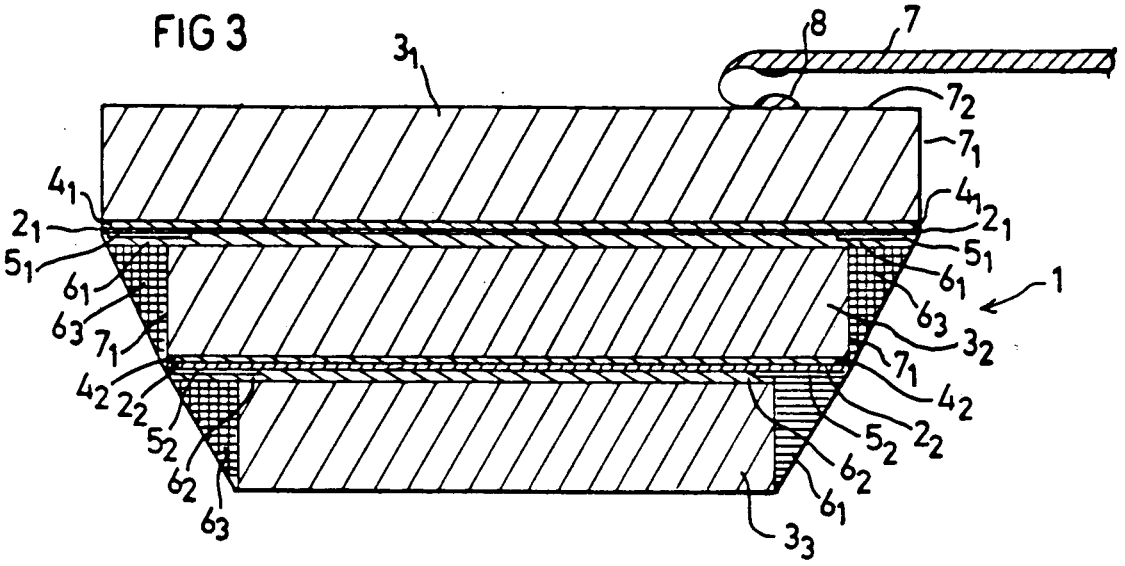
FIG. 3 is a transverse sectional view illustrating one version of a double-pattern resistor element constructed in accordance with the present invention.
Figure 7:
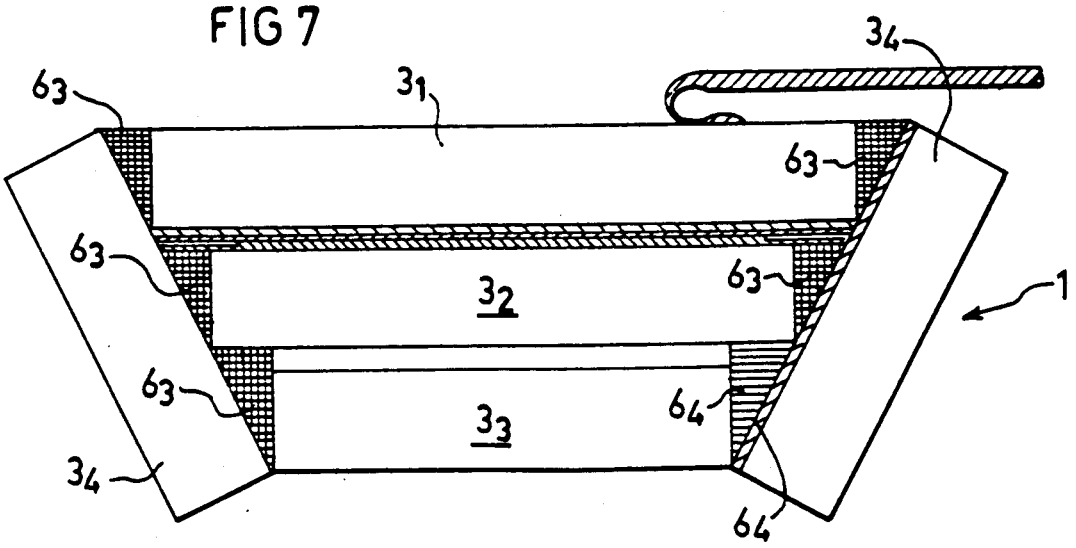
FIG. 7 illustrates the double-pattern resistor element of FIGS. 3-4 but provided with side plates covering and bonding the margins of the resistor element.

FIG. 7 represents the embodiment of FIG. 3 but with two bonded side plates produced from the same material as the substrates. These plates are intended for additional moisture protection of the termination pads located on the substrates margins, together with the connecting leads and the paths of the cut and uncut shunts of the final R- and TCR-trimming steps.

Figure 2:
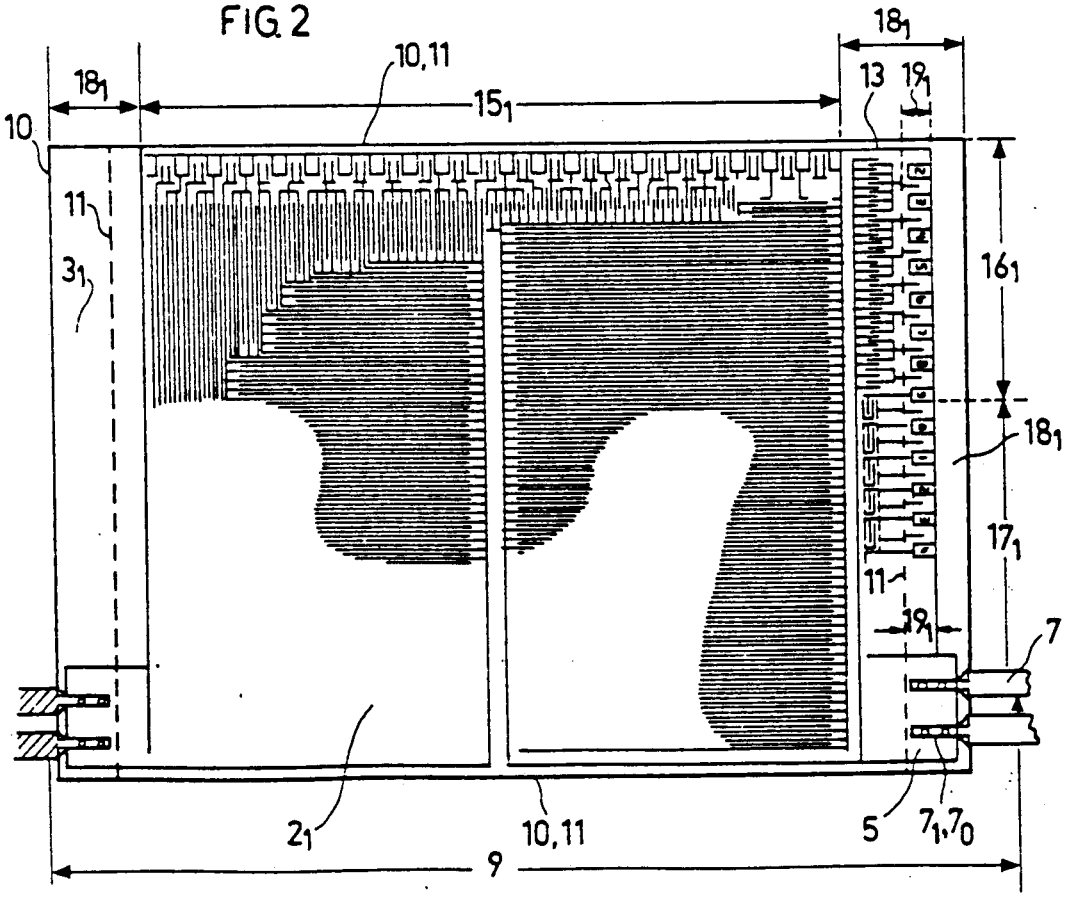
FIG. 2 is a plan view illustrating the resistive pattern in the resistor element of FIG. 1.
Figure 4:
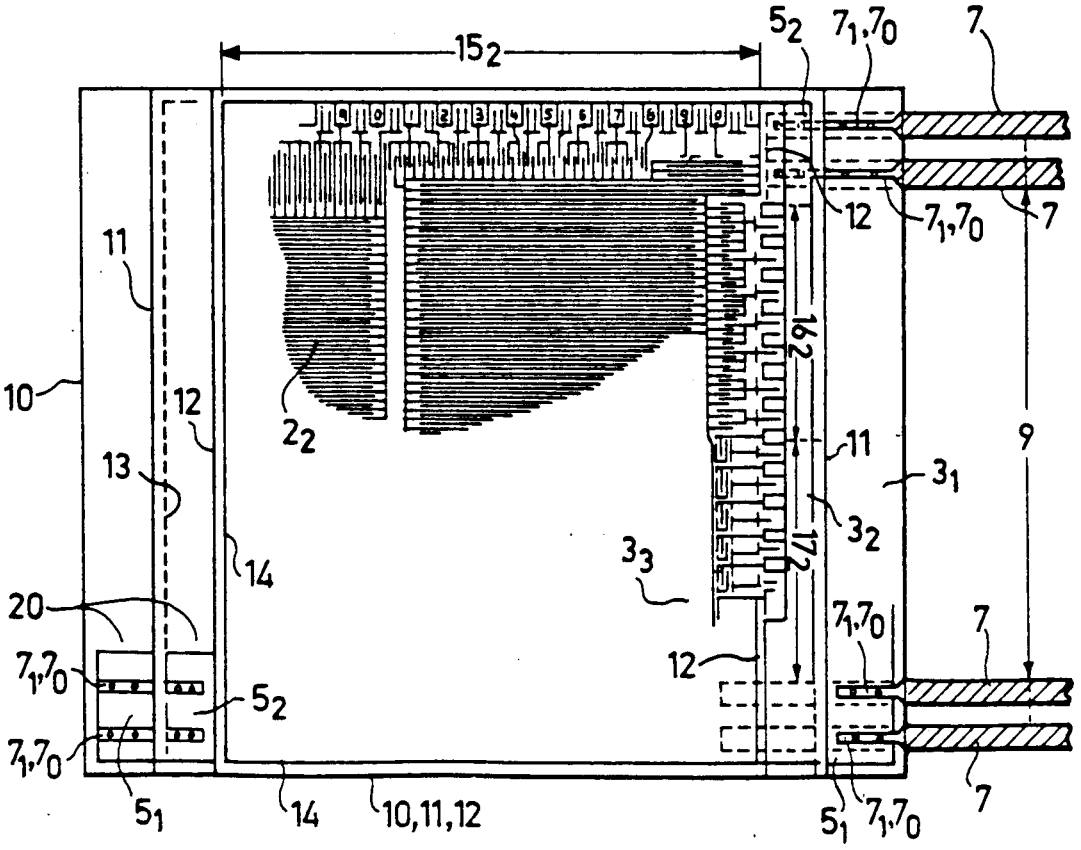
FIG. 4 is a plan view illustrating the second pattern in the double-pattern resistor element of FIG. 3.
Figure 6:
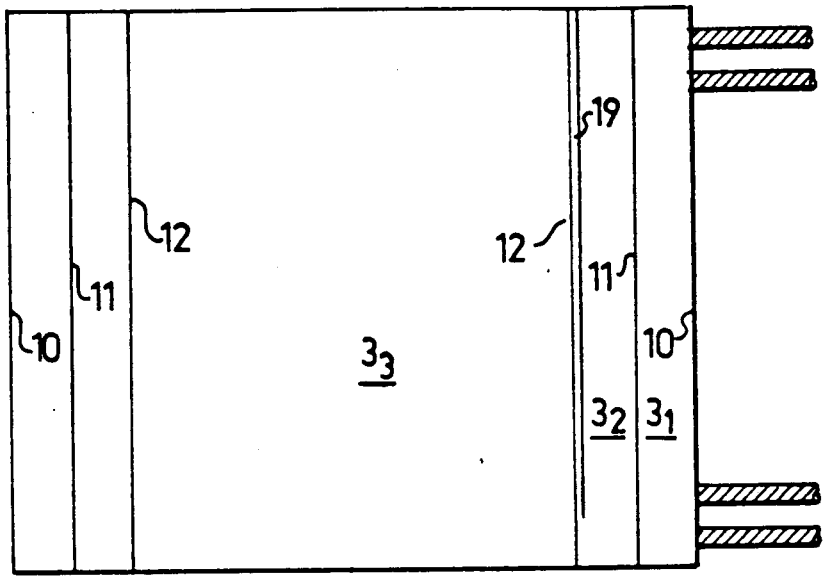
FIG. 6 illustrates the outlines of the various layers in the resistor element of FIGS. 3-4.

FIGS. 2, 4 and 5 are plan views of resistor elements per FIGS. 1, 3 and fourth embodiment before bonding thereto the bottom substrate without a pattern. These figures represent patterns of the embodiment of FIG. 1, the second pattern of the embodiment of FIG. 3 and the two patterns of the fourth embodiment wherein these patterns are located in the same sectional plane. FIG. 6 is a plan view of a finished sealed resistor element according to the construction of FIG. 3.

The resistor element illustrated in FIGS. 1 and 2 comprises the first basic substrate $3_1$ of insulating material, a resistive metal foil pattern 2, bonded by a cement layer $4_1$ to one face of substrate $3_1$, and a second substrate $3_2$ of insulating material of less width bonded by cement layer $6_1$ to pattern $2_1$ so as to sandwich its resistive part between the two substrates $3_1$ and $3_2$.

The resistive pattern $2_1$ comprises in its turn non-trimming part, and three margins: two side margins 18, where are located copper-nickel-gold plated termination pads $5_1$—$5_1$ of high conductivity connected by leads 7 and final R- and TCR-trimming steps ($17_1$, $16_1$) with the paths of their uncut and cut shunts ($19_1$). Along the third upper margin are located coarse R-trimming steps.

Substrate $3_2$ is of less width than the basic substrate $3_1$, and its basic pattern $2_1$, so that after assembling the sandwich, the following are exposed: parts of termination pads $5_1$—$5_1$ for the lead connections and path $19_1$ of the shunts which can be cut or restored and in this way to carry out R- and TCR-trimmings in two directions.

The cut and uncut shunts of the final R-trimming steps $17_1$ are copper-nickel-gold plated and have enlarged sizes in order to facilitate reinserting a cut shunt by soldering or welding.

The final TCR-trimming steps have similar shapes as the R-trimming steps but are copper-nickel-gold plated, and therefore their resistances become temperature sensitive.

FIGS. 3, 4 and 7 illustrate two embodiments of double pattern resistor elements comprising three insulating substrates $3_1$, $3_2$ and $3_3$ sandwiching between them two series connected metal foil patterns $2_1$ and $2_2$ so that one of them is above the other. Thus, one resistive pattern $2_1$ is sandwiched between substrates $3_1$ and $3_2$ These elements correspond to single-pattern embodiment of FIGS. 1 and 2 and are constructed in the same manner as described above with respect to FIGS. 1 and 2. Accordingly, their various elements are identified by the same reference numerals in FIGS. 3 and 4. The second resistive pattern $2_2$, and the third insulating substrate $3_3$, are constructed in the same manner as pattern $2_1$ and insulating substrate $2_2$. Since insulating substrate $3_3$ is of less width than resistive pattern $2_2$ and its substrate $3_2$, the opposite sides of resistive pattern $2_2$ are also exposed by substrate $3_3$, one side being covered by the same permanent sealing material $6_3$ as in the one-pattern embodiment of FIG. 1. However, since only one of resistive patterns may be used in certain cases for performing initial fine trimmings, as well as subsequent retrimmings, the right side of only pattern $2_2$ may be provided with final R- and TCR-trimming steps $17_2$ and $16_2$ corresponding to $17_1$ and $16_1$ final steps of FIG. 2. Accordingly, the right side of resistive pattern $2_1$ need not be provided with final trimming steps, and part of insulating substrate $3_1$ exposed by substrate $3_2$ may be covered by a permanent sealing material $6_3$. On the other hand, the right side of resistive pattern $2_2$ may be provided with final R- and TCR-trimming steps $17_2$ and $16_2$ and their shunts exposed by insulating substrate $3_3$. Path $19_2$ of these shunts is covered by removable sealing material $6_4$ to permit retrimming of the resistor element while a part of terminal pads $5_2$—$5_2$ may be covered by a permanent sealing material $6_3$.

The resistor element illustrated in FIGS. 3, 4 comprises two resistive patterns $2_1$ and $2_2$ each of which is located and bonded between two adjacent layers $4_1$ and $6_1$, and $4_2$ and $6_2$ by using appropriate cements, and two substrates $3_1$ and $3_2$ and $3_2$ and $3_3$. Side plates $3_4$—$3_4$ (FIG. 7) and hermetic materials $6_3$, $6_4$ (FIGS. 1,3) are intended for double moisture protection of these sides where are located communication junctions and the paths of cut and uncut shunts of the final R-and TCR-trimming steps of the resistor element. For moisture protection of the sides (see $6_3$, $6_4$ of FIGS. 1, 3, 7), a number of epoxies and other thermoreactive resins and compounds of irreversible operation ($6_3$) may be used as hermetic sealing materials for the regions where there is no need for accession and baring of the path of cut and uncut shunts of the final R- and TCR-trimming steps. This path of shunts may be used during periodical verifications for R- and TCR- retrimmings in two directions. For this shunt region, there may be used one of the known removable sealing materials ($6_4$), e.g., silicon gel of RTV619, together with silicon primer of SS4155, produced by General Electric Co.

It is preferable to use, for patterns bonding in this invention, cement of high adhesion and shear stress without appreciable creep, since such shear stresses will be developed in the cement layers every time there is a change in temperature of the metal foil patterns. It is important also that the used cement will be devoid of any solvent or other volatile component and will have high thermal stability; as an example, there may be used epoxy MM-139.

The pad termination regions $5_1$—$5_1$ and $5_2$—$5_2$ connected by a resistive path of pattern $2_1$ and pattern $2_2$ are copper-nickel-gold plated. This plating is often used for the uniform introduction of current from the leads to the resistive patterns, for the qualitative connection of the leads to pads regions (welding, soldering), and for the possibility of the preliminary R-trimming and TCR testing the patterns before lead connection and assembling the resistor element.

Each of four monolithic terminal copper leads 20 (FIGS. 1, 3) has one external cylindrical part 7 and two flattened parts $7_1$, $7_2$, as was explained above.

In accordance with the present invention, substrates $3_1$, $3_2$, $3_3$ and side plates 34 are chosen from the same insulating inorganic material having a coefficient of thermal expansion which is zero or as close to zero as possible. For example, certain ceramic materials, such as those marketed under the tradenames "Corderite" (coefficient about 0), "Cermet" (coef. of $5.4\times10^{-6}/^{o}C$ ($3\times10^{-6}/^{o}F$), "Alumina" (coef. of $6.3.10^{-6}/^{o}C$ ($3.5\times10^{-6}/^{o}F$) are useful in this regard. The substrates will generally be of thickness of the order 0.51 mm to 2.54 mm (20 mils to 100 mils).

For the resistive materials with opposite curvatures and slopes of TCR-characteristics to form resistive patterns $2_1$, and $2_2$, there may be used the above-mentioned nickel-chrome alloy foils, like "C" and "K" types. Resistive foil patterns will be of thickness in the order of 1.27 microns to 7.62 microns (50 microinches to 300 microinches), depending upon the resistance value of the resistor element.

Another embodiment of double-pattern resistor elements is illustrated in FIG. 5, which is a plan view of two series connected patterns $2_1$ and $2_2$ located in the same plane and bonded on adjoined substrates $3_1$ and $3_2$. On the side margins (18) of each of these pattern are located paths (19) of cut and uncut copper-nickel-gold plated shunts of final R (17)- and TCR (16)-trimming steps, and also pad terminations (5) with the leads for the inner (8) and external (7) connections. To the resistive parts of two patterns including their coarse R-trimming steps is bonded the third common substrate ($3_3$) so that after assembling the resistor element it is possible to carry out its final trimmings.

It will be understood that using sandwiched metal foil patterns not only eliminates the physicalmechanical mechanical influences upon them from their surroundings, but also decreases considerably the shear stresses in the cement layers and therefore also the pattern "creep".

On the other hand, it is highly undesirable to have any influences of possible temperature gradients across the sandwich upon, first of all, shear stress between bonded substrates and their corresponding bending and resistance deviation. The influence of the power coefficient $P_c$ upon temperature resistance deviation [expressions (6) and (12)] is also important as well as recognized in U.S. Pat. No. 4,677,413 issued in the name of F. Zandman and J. Szwarc, such resistance deviation is caused by heattransfer phenomenon of gradually thermal expansion of substrates in the initial period after applying high power to the resistor element. To overcome the abovementioned influences, the selection of materials used for the substrates will depend upon the substrates' coefficient of thermal expansion, since this parameter is to be maintained either zero or as close to zero as possible.

On the other hand, it should be emphasized that sandwiched patterns have additional advantages compared with usual metal foil resistors with respect to the process of self-heating, which in this instance is symmetrical on two sides of the bonded substrates and produces smaller temperature increases for the same patterns, substrates and power, because of the double thermic capacity of the sandwich.

It will be emphasized also here that the condition of $\alpha_s=0$ is necessary, but not enough for elimination of the influence of power dissipation upon the temperature resistance deviation of a two- pattern resistor element. According to expression (10), in the present invention the equations (13), (14), (15) are to be supplemented with the equal selfheating effects of the two patterns. For this purpose the basic pitches, as well as the squares per pitch, of the resistive paths of both patterns are selected to be approximately the same for equal resistivities of pattern foils. In this respect, the embodiment of the double-pattern resistor element illustrated in FIG. 5 is the most preferable one due to its uniform distribution of self-heating along the substrates, certainly in the case of the equality by the basic pitches, squares per pitch, and resistivities of the patterns.

FIG. 7 illustrates a variation wherein the two opposite sides of the three insulating substrates $3_1$, $3_2$ and $3_3$ including their resistive patterns $2_1$ and $2_2$ and their end seals $6_3$ and $6_4$ are covered by side plates $3_4$—$3_4$ and bonded to the end seals in any suitable manner. These side plates provide additional protection to these seals. Left side plate $3_4$ is preferably permanently fixed to the resistor element, whereas the right plate $3_4$ is conveniently removable in order to provide access to seal $6_4$, which is also conveniently removable as described above in order to provide access to the shunts $19_2$ of the final R- and TCR-trimming steps $17_2$ and $16_2$ of pattern $2_2$ whenever it is necessary to retrimming the resistor element. Similar side plates may, of course, also be provided with respect to the single-pattern resistor element of FIGS. 1 and 2 and with respect to double-pattern resistor element of FIG. 5.

The serpentine shape of the patterns $2_1$ and $2_2$, with resistive path connected between termination pads $5_1$—$5_1$ and $5_2$—$5_2$ and R-trimming steps, may be generally in accordance with U.S. Pat. Nos. 4,172,249 and 4,378,549, issued in the name of J. Szwarc, but with the following modifications:

1. According to the present invention, the basic pitches, as well as squares per pitch, of the two resistive paths of the double pattern resistor elements are equal, or close to equal so that the self-heatings of the two patterns will be substantially equal if the resistivities (Ohms/square) of the patterns are close to each other.
2. The resistances $R_1(T_o)$ and $R_2(T_o)$ of the two patterns resistor element are determined by the following equations:

$$R_1(T_o) = \frac{R(T_o) \times |\beta_2/\beta_1|}{1 + |\beta_2/\beta_1|}; \quad (16)$$

-continued $$R_2(T_o) \times \frac{R(T_o)}{1 + |\beta_2/\beta_1|}, \text{ where}$$

$R(T_o)$—resistance value of the designed resistor element. As to the slopes $S_1(T_o)$ and $S_2(T_o)$ they are selected so that:

$$\frac{S_2(T_o)}{S_1(T_o)} \approx \beta_2/\beta_1 \text{ or } S_2(T_o) \approx 0 \text{ and } S_1(T_o) \approx 0 \quad (17)$$

When the resistor element is assembled from foil alloy modifications having $\rho_1$, and $\rho_2$ of the same sign, there are two possibilities: to use one pattern embodiment (FIG. 1,2 with a lower $\rho$ and $S(T_o) \approx 0$, or to use the two pattern version in which two foil batches have opposite signs of $S_1(T_o)$ and $S_2(T_o)$ slopes. Then, the resistance values of pattern are determined in the manner similar to Equation (16):

$$R_1(T_o) = \frac{R(T_o) \times |S_2(T_o)/S_1(T_o)|}{1 + |S_2(T_o)/S_1(T_o)|} \quad (18)$$

$$R_2(T_o) = \frac{R(T_o)}{1 + |S_2(T_o)/S_1(T_o)|}$$

3. The trimming steps of patterns $\mathbf{2}_1$ and $\mathbf{2}_2$ are generally designed for both coarse and fine R- and TCR-trimmings. But sometimes one pattern of a two-patterns resistor element may be intended only for coarse R-trimming as is illustrated on FIG. 4 (pattern $\mathbf{2}_1$) or both patterns may be intended only for coarse and fine R-trimmings.
4. The finest R-trimming steps $\mathbf{17}_2$ of pattern $\mathbf{2}_2$, FIG. 4, and $\mathbf{17}_1$ of pattern $\mathbf{2}_1$; FIG. 2, and $\mathbf{17}_1$, $\mathbf{17}_2$ of patterns $\mathbf{2}_1$ and $\mathbf{2}_2$; FIG. 5, have a copper-nickel-gold plated path (18) of cut and uncut elongated shunts, so that will permit, when necessary to restore easily the cut steps, e.g. by soldering or welding, and thereby to carry out R-fine trimming also in the negative direction.
5. The low value TCR-trimming steps $\mathbf{16}_2$ of patterns $\mathbf{2}_2$ (FIG. 4), $\mathbf{16}_1$ of pattern $\mathbf{2}_1$ (FIG. 2) and $\mathbf{16}_1$,$\mathbf{16}_2$ of patterns $\mathbf{2}_1$ and $\mathbf{2}_2$ (FIG. 5), are appropriate copper-nickel-gold plated, and therefore temperature sensitivities, have similar shape as the R-trimming steps and the cut and uncut elongated shunts and they are also suitable for TCR-trimmings in two directions without disturbing the linearization conditions of TCR-characteristic $$\left(|\beta_2/\beta_1| = \frac{R_1(T_o)}{R_2(T_o)}\right).$$

6. Trimming the finest R- and TCR-steps (17 and 16 of FIGS. 2, 4 and 5) by cutting, or e.g., soldering, appropriate shunts of path 19 is carried out while the resistor element is assembled, but the shunts' path 19 is bared. Only after final R and TCR-trimmings, the path regions are protected if necessary by removable hermetic material $\mathbf{6}_4$ and in the embodiment of FIG. 7, this material is also used for bonding the right side plate $\mathbf{3}_4$. It is very important to verify periodically the "sealed resistor element" and, in case of need, to remove the right side plate $\mathbf{3}_4$ and to bare place 19 for final R- and TCR-retrimmings.
7. Metal foil batches of a given curvature ratio:

$$\frac{C_2(T_o)}{C_1(T_o)} = \beta_2(T_o)/\beta_1(T_o)$$

are chosen so that their TCR slops $S_2(T_o)$ and $S_1(T_o)$ are zero or close to zero (FIG. 8), or their ratio $$\frac{S_2(T_o)}{S_1(T_o)}$$

is close to $$\frac{C_2(T_o)}{C_1(T_o)}$$

(FIG. 9), but, in any case, if the initial (before TCR-trimming) slope $S(T_o)$ of the element is negative or positive in the given range, it is possible to effect TCR-trimming up to $S=0$ by cutting temperature sensitive steps or by soldering the cut steps. The surface sizes of the resistor element depends upon the rated power that should be dissipated, the quality and thickness of the used foils, the standard of the etching technology, and the required accuracy of the resistor element. But the sizes of basic patterns are preferred to be not less than 5 times that of the standard chips pattern i.e., approximately 21.8×24.4 mm (0.85×0.95").

The following sequence of production steps is preferred for assembling the resistor elements illustrated in FIGS. 3, 4, 7:

1. The plates of patterns $\mathbf{2}_1$ and $\mathbf{2}_2$ and their preliminary R and TCR test are prepared and suitable pairs of plates are selected for double-pattern resistor elements and appropriate coarse $R_1$-trimming of pattern $\mathbf{2}_1$ is carried out.
2. Two selected pairs of plates are bonded together so that the pattern $\mathbf{2}_1$ will be inside and pattern $\mathbf{2}_2$ - outside.
3. Coarse $R_2$-trimming of the pattern $\mathbf{2}_2$ is then effected.
4. The substrate $\mathbf{3}_3$ is bonded on the pattern $\mathbf{2}_2$ and a plate $\mathbf{3}_4$ to the left side of the sandwich (embodiment per FIG. 7).
5. TCR and final R-trimmings of the resistor element are effected.
6. The resistor element is then finally assembled.

Assembling the double-resistor element illustrated in FIG. 5 is carried out by approximately varying the above sequence of steps.

The foil thermal treatment, its lamination, its bonding to the substrates, the photo-etching technology, the copper-nickel-gold plating, the lead connections and so on, are preferably carried out in accordance with the best techniques which are generally known in this art. Of course, the sealed resistor element, and its parts and assembling must be carried out extremely carefully so as not to induce any sources of resistance deviation. Optimal selection of resistive foils, substrates, cements, hermetic materials, and patterns design should be taken in account.

The resistor element may be assembled also in the form of a dual resistor with ratio $R_1$:$R_2$ for some network applications. It is preferable to use for this purpose two single (on one substrate) or double pattern resistor elements per FIG. 5 bonded together in a symmetrical manner between their greater substrates or by using common middle substrates with patterns on two sides.

What is claimed is:

1. A high-precision, high-stability resistor element, comprising:

a first substrate of insulating inorganic material having a substantially zero coefficient of thermal expansion;

a resistive metal foil pattern carried and bonded on one face of said substrate;

and a second substrate of insulating inorganic material having a substantially zero coefficient of thermal expansion bonded to said pattern so as to sandwich the resistive pattern between the two substrates.

2. The resistor element according to claim 1, wherein said pattern includes coarse and final trimming steps and pad terminations connected to a resistive path of the element, and connectible to external leads, said final trimming steps including paths of cut and uncut shunts and being located on at least one side margin of said resistor element.

3. The resistor element according to claim 2, wherein the resistive part of the pattern includes coarse R-trimming steps and is bonded between said first and second substrates such as to expose said at least one side margin of the final trimming steps to permit final trimmings after the sandwich is assembled.

4. The resistor element according to claim 3, wherein said at least one side margin, together with said shunts of the final trimming steps, are protected by a hermetically-sealed material.

5. The resistor element according to claim 2, wherein said pad terminations are of copper-nickel-gold plated and are connected by resistive paths made from a resistive metal foil having a low absolute value of curvature and slope of its TCR-characteristic.

6. The resistor element according to claim 2, wherein the shunts of the final R-trimming steps are copper-nickel-gold plated and have sizes sufficient to permit R-trimming in two directions, namely, by adding shunts for R-decreasing, and by cutting shunts for R-increasing.

7. The resistor element according to claim 6, wherein it further includes temperature sensitive steps for TCR-trimming up to zero formed similar to the R-trimming steps, said TCR-trimming steps being copper-nickel-gold plated and including cut and uncut shunts of sizes permitting TCR-trimmings in both directions, namely in the positive direction by cutting step shunts, and in the negative direction by adding cut step shunts.

8. The resistor element according to claim 5, wherein it further includes: a second metal foil pattern, having the same order of magnitude of TCR-characteristic but of smaller size than the first-mentioned basic pattern, carried and bonded on the opposite face of said second substrate and series connected to the first-mentioned pattern; and a third substrate made of the same insulating material as the other two substrates and bonded to said second pattern so as to sandwich it between the second and third substrates.

9. The resistor element according to claim 8, wherein said second pattern also includes: coarse and final R- and TCR-trimming steps, a side margin on which are located copper-nickel-gold plated pad terminations connected to external and inner leads and to the resistive path of the pattern; and paths of cut and uncut shunts of the final R- and TCR-trimming steps; the resistive part of the second pattern, including its coarse R-trimming steps, being bonded to the said third substrate permitting the final trimmings of this pattern, and also the whole resistor element to be carried out on both patterns margins; the latter margins, together with the external junctions, being protected by hermetic materials.

10. The resistor element according to claim 9, further including side plates of the same insulating material as the substrates, and bonded to the margin sides thereof.

11. The resistor element according to claim 9, wherein said two patterns are made of metal foils having opposite signs of curvatures and slopes, and having such ratios of these parameters, and also of the resistances of the patterns, that the curvature and slope of the combined TCR-characteristics of the resistor element are virtually zero at the middle of a given temperature range.

12. The resistor element according to claim 11, wherein said two patterns are made of metal foils having close resistivities/Ohms/square/and substantially the same basic pitch, and squares per pitch, such that the selfheatings of two series connected patterns are approximately the same.

13. The resistor element according to claim 12, wherein each of said patterns is bonded between adjacent substrates by cement having high adhesion and shear stress without appreciable "creep", having no solvent or other volatile component, and having high thermal stability in the given temperature and power ranges.

14. The resistor element according to claim 13, wherein said substrates and side plates are each made of an inorganic insulating material having a coefficient of thermal expansion not more than $6.3\times10^{-6}/^{o}C$ ($3.5\times10^{-6}/^{o}F$) and a thickness of 0.51 mm to 2.54 mm (20 mils to 100 mils).

15. The resistor element according to claim 13, wherein each of said patterns is made of a nickel-chrome alloy foil of a thickness from 1.27 microns to 7.62 microns (50microinches to 300 microinches).

16. The resistor element according to claim 15, wherein the surface size of said first-mentioned pattern is not less than $21.8\times24.4$ mm ($0.85\times0.95''$), and said resistor element embraces trimming steps of up to 0.2–0.5 ppm and up to 0.01–0.02 ppm/$^{o}$C.

17. A high-precision and high-stability resistor element which exhibits zero or close to zero resistance deviation during time and in given temperature and power ranges, said resistor element comprising a bonded sandwhich of at least three insulating substrates with at elast two resistive metal foil patterns located and bonded in several planes between adjacent substrates, each of said substrates being of an inorganic material having a substatially zero coefficient of thermal expansion.

18. The resistor element according to claim 17, wherein each of said patterns has side margins, said side margins containing projected pad terminations with connected resistive paths, and external and inner connecting leads and also projected paths of cut and uncut shunts of final trimming steps; one of said substrates being of smaller size than the other; the resistive patterns of each plane, including their coarse R-trimming steps, being bonded adjacent to the smaller substrate such that final trimmings of each pattern may be are carried out on said margins while the said sandwhich is assembled, said margins and all external junctions being protected by hermetically-sealed materials.

19. The resistor element according to claim 18, wherein each of said sandwich patterns has cooper-nickel-gold plated pad terminations, connected by resistive paths of patterns made form resistive metal foil with low absolute values of slope and curvature of its TCR-characteristic.

20. The resistor element according to claim 17, wherein said resistor element comprises two insulating adjoined substrates placed in one plane and forming a rectangle, two series connected metal foil patterns bonded from both sides and sandwiched between each of said substrates, and a common third insulating substrate smaller than the above rectangle so that on the side margins of each pattern are located pad terminations with external and inner connecting leads and paths of cut and uncut shunts of the final trimming steps while the rest of the resistive parts of the patterns including their coarse R-trimming steps are bonded adjacent to said common substrate.

21. The resistor element according to claim 17, wherein said two patterns are made of resistive metal foils with opposite signs of curvature and slopes and such ratios of parameters, and also resistances of patterns, that the curvature and slope of the combined TCR-characteristic of said resistor element are virtually zero at the middle of the given temperature range.

22. The resistor elements according to claim 17, wherein said two patterns are made of resistive metal foils of the same sign of curvature but opposite slopes of their TCR-characteristics, and have such resistances that the slope of the combined TCR-characteristic of resistor element is zero at the middle of the given temperature range.

23. The resistor element according to claim 17, wherein said patterns are made of foils of similar resistivities have similar basic pitches and squares per pitch of their resistive paths so that the selfheatings of the series connected patterns are close to each other.

24. The resistor element according to claim 1, wherein said sandwich is formed of two substrates and at least one pattern located and bonded between them.

25. The resistor element according to claim 17, comprising two pattern resistor elements bonded together in a symmetrical manner on opposite sides of a common middle substrate.

* * * * *